United States Patent [19]

Dunbar

[11] 4,018,243

[45] Apr. 19, 1977

[54] ADJUSTABLE CHECK VALVE FOR USE IN AN OXYGEN REGULATOR

[75] Inventor: Jack E. Dunbar, Davenport, Iowa

[73] Assignee: The Bendix Corporation, South Bend, Ind.

[22] Filed: Dec. 8, 1975

[21] Appl. No.: 638,254

[52] U.S. Cl. ..... 137/81; 137/DIG. 9; 137/114; 137/543.15

[51] Int. Cl.[2] ..... A62B 9/00

[58] Field of Search ..... 137/81, 99, 114, 543.15, 137/DIG. 9; 128/142.2

[56] References Cited

UNITED STATES PATENTS

| | | | |
|---|---|---|---|
| 2,396,716 | 3/1946 | Meidenbauer et al. | 137/81 |
| 2,436,522 | 2/1948 | Meidenbauer | 137/81 |
| 3,509,895 | 5/1970 | Henneman | 137/81 |

*Primary Examiner*—Alan Cohan
*Assistant Examiner*—Richard Gerard
*Attorney, Agent, or Firm*—Leo H. McCormick, Jr.; William N. Antonis

[57] ABSTRACT

An adjustable check valve for use in an oxygen regulator to establish limits at which a resiliently biased disc moves away from a seat to allow air to enter an atmospheric chamber. A regulator is connected to a linkage which operates an air flow valve and an oxygen proportioning flow valve. The regulator is responsive to inlet oxygen pressure such that a change in altitude causes a corresponding change in flow relationship of air through the air valve and oxygen through the oxygen valve.

10 Claims, 2 Drawing Figures

ADJUSTABLE CHECK VALVE FOR USE IN AN OXYGEN REGULATOR

BACKGROUND OF THE INVENTION

U.S. Pat. No. 3,496,954 discloses an altitude sensor for operating an oxygen regulator which supplies a recipient with oxygen enriched air up to a predetermined altitude and thereafter pure oxygen to maintain normal physiological functions. However, it was found that by tying an oxygen flow proportioning control valve to an air flow valve, as shown in U.S. Pat. No. 3,509,895, it was possible to provide a fixed proportional relationship for the mixing of oxygen and air. It was later determined that a check valve was required to assure that oxygen was not communicated to the atmosphere during periods of expiration by the recipient. Unfortunately, such check valves were not readily accessible for maintenance or adjustment.

SUMMARY OF THE INVENTION

I have devised a check valve means with an adjustable poppet for use in an oxygen regulator. The check valve means has a base member with an axial opening therethrough. The poppet means is resiliently held against the base member to form a seal for the axial opening. A backing plate attached to a retainer holds the resilient means. A stem means extends through the poppet and is connected to the retainer. Threads on the stem means engage the backing plate to change the spring load on poppet means and thereby set limits on the inhalation force required to permit communication of air to an atmospheric chamber. An oxygen proportioning control valve and an air control valve are connected through a linkage system which is responsive to the inlet pressure of the oxygen supply as modified by a sensing means. The sensing means in response to altitude allows the linkage means to move the oxygen proportioning control valve an the air control valve from a position wherein a recipient receives a fluid mixture of oxygen enriched air to a position where pure oxygen is delivered to the recipient in order to maintain normal physiological functions of the recipient.

It is therefore the object of this invention to provide an oxygen regulator with an adjustable check valve means to control the communication of air at atmospheric pressure to an atmospheric chamber.

It is a further object of this invention to provide a check valve means with an adjustable guide for changing the spring load by which a poppet is held against a seat.

It is another object of this invention to provide an oxygen regulator having an oxygen proportioning control valve tied to an air control valve with an adjustable check valve means whereby the proportional force required to open the check valve means can be varied to meet changes in the operational parameters of the oxygen regulator to assure a proportional fluid mixture is produced from the relationship of the oxygen proportioning control valve and the air control valve.

These and other objects will become apparent from reading this specification and viewing the drawing.

DETAILED DESCRIPTION OF THE PREFERRED EMBODIMENT

Figure 1:
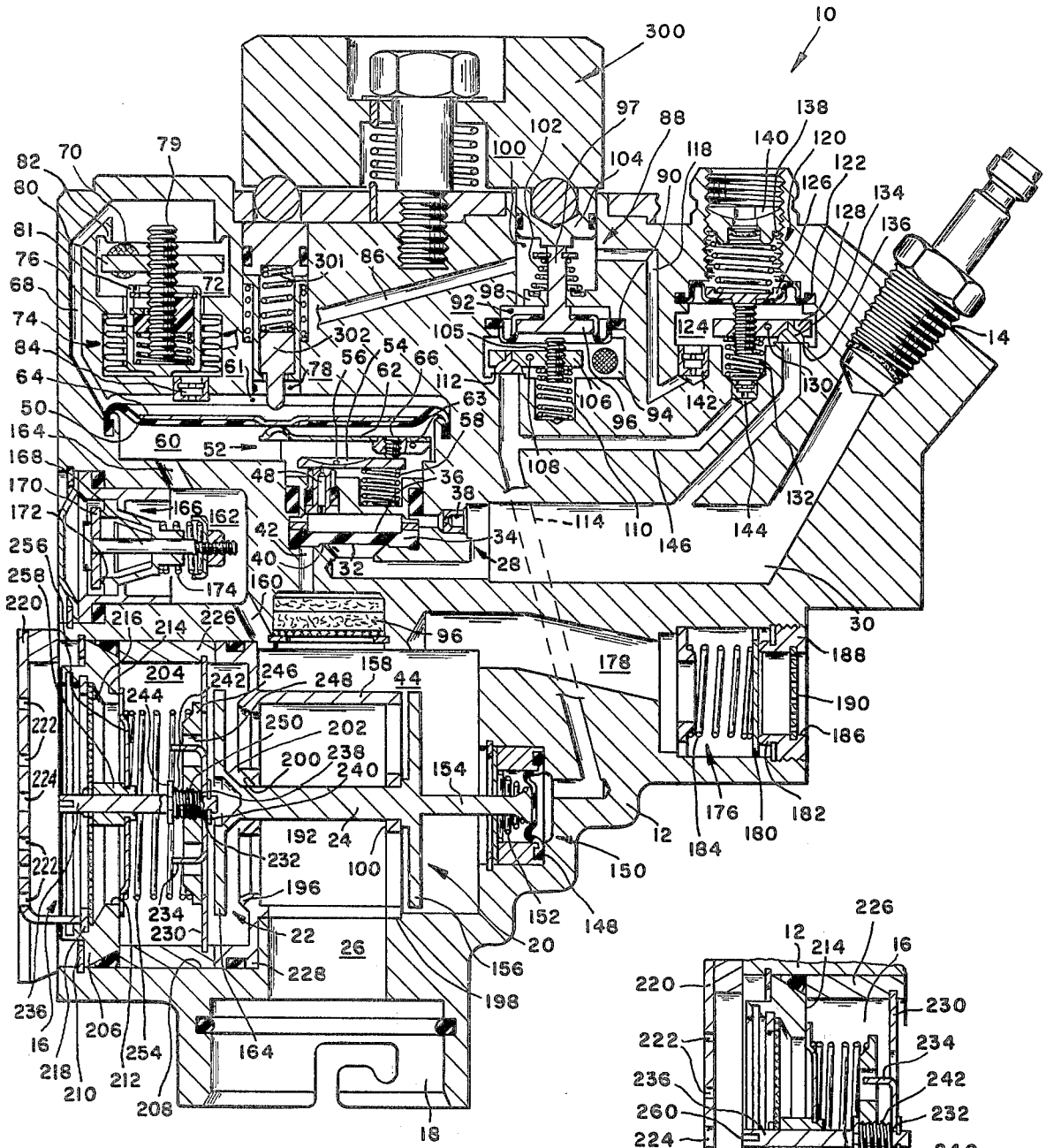
FIG. 1 is a sectional view of an oxygen regulator having an adjustable check valve means for controlling the admission of air at atmospheric pressure to an atmospheric chamber.

The oxygen regulator 10 shown in FIG. 1 has a body 12 with a first inlet port 14 connected to a source of oxygen under pressure, a second inlet port 16 connected to the atmospheric and an outlet port 18 connected to a breathing mask of an aircraft pilot, crew member or other recipient. An oxygen proportioning valve means 20 and an air valve means 22 are tied together by a stem or linkage 24 to control the flow of oxygen and air at atmospheric pressure into a mixing chamber 26 for distribution through the outlet port 18.

The flow of oxygen is controlled by the main valve means 28 located in the housing 12. A main passage 30 connects the inlet port 14 with the lower side 32 of the diaphragm 34. The top side 36 of the diaphragm 34 is connected to the main passage through a restriction or orifice 38. As the oxygen under pressure stabilizes on both sides of the diaphragm, the diaphragm is urged against annular seat 40 to prevent oxygen flow through passages 42, only one being shown, past filter and noise suppressor 46 into the oxygen distribution chamber 44. The top side 36 of the diaphragm 34 is connected through orifice 48 to the bottom side of breathing diaphragm 50. Communication through orifice 48 is controlled by pilot valve means 52.

The pilot valve means 52 has a first lever 54 pivotally attached to housing by pin 56. A spring 58 holds the end of the first lever 54 against the orifice 48 to prevent oxygen from flowing into the diaphragm breathing chamber 60. A second lever 62 has one end pivotally connected to the housing by pin 63 and another end contacting the backing plate 64 of the breathing diaphragm 50. A set screw 66 contacts the second lever 62 with the first lever 54.

The top side of the breathing diaphragm 50 is connected to the atmosphere through passage 68 and opening 70 in atmospheric chamber 72. A sensing means 74 having an expandable bellows 76 is located in a control chamber 78. A stem 79 which extends from the bellows 76 into the atmospheric chamber 72 has a disc 80 attached to the end thereof. The disc 80 is adapted to be moved toward seat 82 as the bellows expands in response to a change in altitude. The control chamber 78 has a first orifice 84 which provides communication with the top side of the breathing diaphragm 50 and a passage 86 which provides communication to a switch over valve means 88.

The switch over valve means 88 has a diaphragm 90 secured to the housing 12 to separate a control chamber 92 from an atmospheric chamber 94. A backing plate 96 which is connected to the diaphragm 90 has a stem 97 which extends through bearing surface 98 into a flow through chamber 100. A spring 102 in chamber 100 urges the stem 97 against a stop 104. A lever arm 106 is pivotally attached to the housing 12 by pin 108 in the atmospheric chamber 94. A spring 110 urges one end of the lever arm 106 against a seat 112 to prevent communication between passage 114 and the atmospheric chamber 94. A set screw 105 is secured to the lever arm 106 and extends toward the backing plate 96.

The flow through chamber 100 is connected by passage 118 to a pressure reducer means 120. The pressure reducer means 120 has a diaphragm 122 secured to the housing 12 to separate an oxygen pressure chamber 124 from the atmosphere. A backing plate 126 contacts lever arm 128. The lever arm 128 is attached to housing 12 by pin 130. A first spring 132 acts on the lever arm 128 to hold face 134 against a seat 136 to prevent communication between the main passage 30 and the oxygen pressure chamber 124. A second spring 138 is located between a stop 140 and the backing plate 126 for urging the lever arm 128 in a pivotal position around pin 130. The oxygen pressure chamber 124 is connected to the passage 118 through a first restrictive orifice 142 and to passage 114 through a second restrictive orifice 144. The second restrictive orifice 144 communicates oxygen under pressure through passage 146 to the passage 114. Since spring 110 holds the lever arm against seat 112, this oxygen under pressure is transmitted to one side of diaphragm 148 in the regulator means 150.

The regulator means 150 has a spring 152 which acts on the stem 154 of the linkage means 24 to oppose movement of the linkage means by the pressure force of the oxygen presented to the diaphragm 148. A first disc 156 attached to stem 24 and the cylindrical housing 158 form the oxygen proportioning control valve means 20 through which oxygen is communicated into the mixing chamber 26.

The oxygen distribution chamber 44 is also connected to the diaphragm breathing chamber 60 by passages 160 and 164 in the outlet relief chamber 162. A pop-off valve 166 located in the outlet relief chamber 162 has a stem 168 which aligns a disc 170 over a seat 172 surrounding an opening and is urged against the same by a spring 174. Whenever the oxygen pressure in the outlet relief chamber reaches a pedetermined valve which could cause harm to the recipient, spring 174 is overcome and a portion of the oxygen under pressure is vented to the atmosphere.

The oxygen distribution chamber 44 is also connected to a suffocation prevention valve means 176 through passage 178. The suffocation prevention valve means 176 has a disc 180 held against a seat 182 by a spring 184. The seat 182 is located around an opening 186 in a threaded plug 188. A filter 190 is located in the opening 186 to prevent contaminants from entering into the oxygen distribution chamber 44 if a suction demand by the recipient is sufficient to move disc 180 away from seat 182 and allow air at atmospheric pressure to enter therein.

A cylindrical housing 158 separates the oxygen distribution chamber 44 from the mixing chamber 16 having a first guide surface 190 and a second guide surface 192 which maintains the stem or linkage means 24 in axial alignment to assure that disc 156 of the oxygen proportioning valve means 20 and disc 194 of the air valve means 22 is aligned with seat 196. Guide 190 limits the relationship between disc 156 and edge 198 such that the oxygen flow from the oxygen distribution chamber 44 is never restricted below a fixed percentage while guide 192 has a contoured surface 200 which corresponds to surface 202 on disc 164 to allow a seal between seat 196 and the disc 164 to allow pure oxygen to be delivered to the recipient from the oxygen distribution chamber 44.

The check valve means 16 which controls the flow of air into the atmospheric chamber 204 has a base member 206 which is held in bore 208 by a snap ring 210. The base member has an axial opening 212 with a flat seat 214 along the interior surface in the atmospheric chamber 204. A filter 216 is located adjacent the axial opening 212 and retained therein by a snap ring 218 which forms part of a protective cover 220. The protective cover 220 has a plurality of holes 222 which allows air to freely flow into the axial opening 222. The protective cover has a maintenance opening 224 into which a tool may be inserted to adjust the check valve means 16. A sleeve 226 is located in bore 208 between the base member 206 and carrier surface 228 of the cylindrical housing 158. A retainer 230 which is secured to the sleeve 226 has an axial opening 232 and a series of tabs 234 which project toward the base member 206. A stem 236 extends through filter 216 and opening 232 until shoulder 238 engages the retainer 230. A keeper 240 is attached to the stem 236 to hold the same in the atmospheric chamber 204. The stem 236 is provided with threads 242 from adjacent the shoulder 238 to stop 244. A spring retainer 246 has a plurality of holes 248 which are mated with tabs 234 to hold the spring retainer from rotating around its axial center when threads 250 engage threads 242. A spring or resilient means 254 which is located on spring retainer 246 urges disc 256 toward the flat seat 214 on the base member 206. The disc 256 is located on a bearing 258 which slides on stem 236.

MODE OF OPERATION OF THE PREFERRED EMBODIMENT

When the oxygen regulator 10 is placed into operation at ground level, a condition as illustrated in FIG. 1 occurs. Oxygen under pressure present in conduit 30 passes through restriction 38 to act on the larger surface area 36 of the diaphragm to urge the lower surface area toward seat 160 to prevent the flow of oxygen through holes 42 into the oxygen distribution chamber 44. At the same time, oxygen under pressure moves face 134 of the pressure reducer means 120 off seat 136 to allow oxygen under pressure to enter chamber 124. This oxygen under pressure creates a pressure differential across diaphragm 122 with the atmospheric pressure which aids spring 132 in urging face 134 toward seat 136. As the oxygen passes through the oxygen pressure chamber 124, it is proportionally reduced in pressure by a factor equal to the spring constant of spring 132 and the pressure differential across diaphragm 122.

However, this oxygen is still under pressure and is simultaneously communicated through restriction 144 for distribution through conduits 146 and 114 to act on diaphragm 148 of the regulator means 150 to hold the air valve means 22 wide open and the oxygen proportioning valve means 20 in a metering position, and through restriction 142, for distribution through conduit 118 to the switch over valve means 88. This oxygen under pressure is also presented to the control chamber 92 whereby a pressure differential is created across diaphragm 90 with air at atmospheric pressure in chamber 94. This pressure differential is opposed by spring 102 in its attempt to move backing plate 96 into engagement with set screw 105 on lever 106 which controls communication between passage 114 and the atmospheric chamber 94. As long as the pressure differential across diaphragm 90 is insufficient to overcome spring 102, spring 110 maintains lever arm on seat 112 to prevent communication between passage 114 and the stmospheric chamber 94.

The same oxygen pressure present in the control chamber 92 is communicated through conduit 86 to act on bellows 76 in the sensing means 74. The bellows acts on housing 79 to urge disc 80 toward seat 82. At the same time this oxygen under pressure flows through restriction 84 into chamber 61 or the top side of the breathing diaphragm 50. This oxygen under pressure is communicated to the atmosphere through passage 68 by flowing past seat 82 into atmospheric chamber 72.

When an inhalation demand for a breath of air or oxygen enriched air is received at the mixing chamber 26, a pressure drop occurs across the breathing diaphragm 50 allowing a pressure differential to move lever 62 around pivot 63 causing screw 66 to move lever 54 around pivot 56 to open orifice 48 and allow the oxygen under pressure or the top side of diaphragm 34 to be communicated into chamber 60. With the termination of the pressure equilibrium across diaphragm 34, the oxygen under pressure acts on the lower face and move the diaphragm away from seat 40 to allow oxygen to flow into the oxygen distribution chamber 44 for communication to the mixing chamber 26. When the inhalation demand has terminated, the oxygen pressure in the oxygen distribution chamber 44 increases. This increase is communicated through conduit or passages 160 and 164 to the bottom side of the breathing diaphragm 50. As the pressure in chamber 60 increases, spring 58 again seats arm 56 on orifice 48 to interrupt communication therethrough to allow the oxygen under pressure in the main passage 30 to flow through restriction 38 and again establish equal oxygen pressure across diaphragm 34. Will equal oxygen pressure on the top and bottom of diaphragm 34, the diaphragm is returned to seal passages 42 from the flow of oxygen past seat 40.

Figure 2:
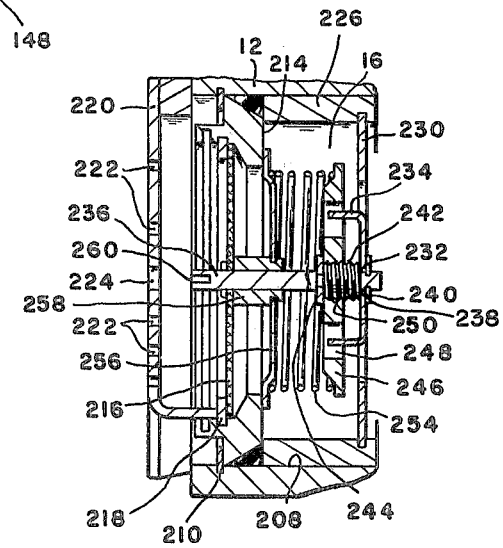
FIG. 2 is a sectional view of the check valve means showing a load changing means moved from a first position to a second position whereby the opening and closing of a poppet member is modified in response to an operational parameter.

During an inhalation demand, the pressure differential created between the mixing chamber 26 and the atmospheric chamber 204 causes disc 256 to move in opposition to spring 254 away from seat 214 to allow air at atmospheric pressure to enter thereinto. However, this inhalation demand may vary for different oxygen supply systems and for this reason it is possible to vary the spring load on disc 256 by the insertion of a tool in slot 260 of stem 236. By rotating stem 236, threads 240 and 250 causes the spring retainer 246 to move axially toward the flat seat 214 by sliding on tab 234, as best shown in FIG. 2, where the spring retainer 246 has been moved to its maximum limit.

When an altitude has been reached that the bellows 76 in the sensing means 74 has moved disc 80 against seat 82, the pressure differential across diaphragm 90 has moved end plate 96 into engagement with set screw 105 causing lever 96 to pivot on pin 108 to allow the oxygen under pressure in passage 114 to be dumped into the atmospheric chamber 94 eliminating the proportioning force on linkage 154 through diaphragm 148. With this pressure differential eliminated, spring 152 moves disc 164 against seat 196 to terminate communication between the atmospheric chamber 204 and the mixing chamber 26 and thereby allow pure oxygen present in the oxygen distribution chamber 44 to be communicated to the recipient.

When the disc 80 is urged against seat 82, the oxygen under pressure in chamber 78 begins to build up in chamber 61 causing a pressure differential to move the breathing diaphragm 50 such that orifice 48 is opened by levers 62 and 56. Now when the inhalation demand occurs, the resistance to opening of the main valve diaphragm 34 is reduced to a point when a positive breathing force is created to support a recipient with a breathable fluid.

The regulator means 10 is also supplied with a manual positive breathing means 300 which when rotated moves piston 302 into a position where the breathing diaphragm 50 acts on the levers 62 and 54 to permit uninterrupted oxygen flow through orifice 48 until sufficient pressure builds up to overcome spring 301 on the other side of piston 302.

As the altitude, in which the oxygen regulator 10 operates, drops below a predetermined positive flow elevation, the pressure differential across the sensing means 74 will again allow chamber 61 to be vented to the atmospheric chamber and lever 106 in the switch over valve means 88 is urged against seat 112. With communication to the atmosphere between passage 114 terminated, the oxygen pressure again acts on diaphragm 148 to move linkage 154 such that a proportional opening of the air valve means 22 results in a proportional closing of the oxygen valve means 20.

I claim:

1. In an oxygen regulator having a housing with a first inlet port connected to oxygen under pressure, a second inlet port connected to receive air at atmospheric pressure from an atmospheric chamber and an outlet port for supplying a fluid mixture to a breathing apparatus, control means for regulating the relationship between said oxygen under pressure and said air at atmospheric pressure in said fluid mixture as a function of altitude, said control means comprising:

oxygen valve means located in said housing between said first inlet port and said outlet port for regulating the rate of flow of oxygen therebetween;

air valve means located in said housing between said second inlet port and said outlet port for regulating the rate of flow of air therebetween;

linkage means connecting said oxygen valve means with said air valve means for proportionally increasing the restriction of one of said oxygen valve means and said air valve means with a decrease in the restriction of the other of said oxygen valve means and said air valve means;

regulating means connected to said linkage means for controlling said restriction of said oxygen valve means and said air valve means as a predetermined function of oxygen inlet pressure;

sensing means responsive to altitude for allowing said linkage means to move to a position in which said air vave means is closed and said oxygen valve means is opened to allow said oxygen under pressure to flow to said outlet port;

check valve means located in said atmospheric chamber for preventing said mixture from being communicated to the atmosphere prior to the closure of said air valve means; and adjustment means connected to said check valve means for establishing limits at which air at atmospheric pressure is admitted to said atmospheric chamber.

2. In the oxygen regulator, as recited in claim 1 wherein said check valve means includes:

base means secured to said housing having an axial opening therethrough, said base forming a seat around said axial opening, said air at atmospheric pressure being communicated through said axial opening into the atmospheric chamber.

3. In the oxygen regulator, as recited in claim 2 wherein said check valve means further includes:

disc means located in said atmospheric chamber for controlling the communication of air at atmospheric pressure into said atmospheric chamber.

4. In the oxygen regulator, as recited in claim 3 wherein said check valve means further includes:

resilient means located in said atmospheric chamber for urging said disc means toward said seat.

5. In the oxygen regulator, as recited in claim 4 wherein said check valve means further includes:

retainer means connected to said base for holding said resilient means in said atmospheric chamber, said retainer means having a first tab and a second tab extending toward said axial opening.

6. In the oxygen regulator, as recited in claim 5 wherein said adjustment means includes:

stem means extending through said disc means and secured to said retainer means for maintaining said disc means in axial alignment with said seat surrounding said axial opening.

7. In the oxygen regulator, as recited in claim 6 wherein said adjustment means further includes:

backing plate means having a first hole and a second hole therein into which said first and second tabs on the retainer means are positioned, said backing plate supporting the resilient means.

8. In the oxygen regulator, as recited in claim 7 wherein said stem means includes:

thread means for engaging said backing plate means, said backing plate means being held from rotating by said first and second tab means while moving toward said disc means upon rotation of said stem to change the load on said resilient means.

9. In the oxygen regulator as recited in claim 8 wherein said check valve further includes:

filter means secured to said base means for preventing any contaminants present in the air from entering into the atmospheric chamber.

10. In the oxygen regulator as recited in claim 9 wherein said check valve means further includes:

bearing means concentrically located on said stem means and connected to said disc means for allowing said disc to move axially away from said seat to allow air to enter into the atmospheric chamber.

* * * * *